US011787079B2

(12) United States Patent
Chepets

(10) Patent No.: US 11,787,079 B2
(45) Date of Patent: Oct. 17, 2023

(54) TABLE SAW BLADE SAFETY SYSTEM

(71) Applicant: Igor Chepets, Brooklyn, NY (US)

(72) Inventor: Igor Chepets, Brooklyn, NY (US)

( * ) Notice: Subject to any disclaimer, the term of this patent is extended or adjusted under 35 U.S.C. 154(b) by 71 days.

(21) Appl. No.: 17/530,237

(22) Filed: Nov. 18, 2021

(65) Prior Publication Data

US 2023/0150165 A1 May 18, 2023

(51) Int. Cl.
*B27G 19/02* (2006.01)
*B26B 29/00* (2006.01)

(52) U.S. Cl.
CPC ..... *B27G 19/02* (2013.01); *B26B 29/00* (2013.01)

(58) Field of Classification Search
CPC ..... B27G 19/02; B27G 19/08; B23D 45/06; B23Q 11/00; B23Q 3/002; Y10T 83/7738; Y10T 83/7734; Y10T 83/2077; Y10T 83/727
USPC ..... 83/397, 478, 477.2, 438, 544, 520, 860, 83/447, 102.1, 490, 444, 4, 46, 480; 144/251.1
See application file for complete search history.

(56) References Cited

U.S. PATENT DOCUMENTS 1,089,223 A * 3/1914 Jenkins ..... B27G 19/02 83/450
1,255,886 A * 2/1918 Jones ..... B27G 19/02 83/478
1,526,128 A * 2/1925 Flohr ..... B27G 19/02 83/477.2
2,007,887 A * 7/1935 Tautz ..... B27G 19/02 83/860
3,105,530 A * 10/1963 Peterson ..... B27G 19/02 144/251.1
3,122,833 A * 3/1964 Houston ..... B21D 28/28 83/191
3,232,326 A * 2/1966 Speer ..... B27G 19/08 83/478
3,249,134 A * 5/1966 Vogl ..... B27G 19/02 144/251.1
3,315,716 A * 4/1967 Mytinger ..... B23Q 3/005 83/438
3,880,032 A * 4/1975 Green ..... B27G 19/02 83/544
5,317,944 A * 6/1994 Hewitt ..... B23Q 3/002 83/447
6,224,127 B1 * 5/2001 Hodge ..... B60P 3/14 83/928

FOREIGN PATENT DOCUMENTS

WO WO 2004/050315 A1 * 6/2007 ..... B27G 19/02

* cited by examiner

*Primary Examiner* — Ghassem Alie
(74) *Attorney, Agent, or Firm* — Mestechkin Law Group P.C.

(57) ABSTRACT

A safety system for a table saw is provided that includes: a generally U-shaped structure having a horizontal bottom segment, a vertical segment extending from a first end of the horizontal bottom segment, and a horizontal top segment extending from a first end of the vertical member opposite the first end of the horizontal bottom segment; a receiver having an end configured for receiving a second end of the horizontal bottom segment opposite the first end thereof; and a saw blade cover coupled to a distal end of the horizontal to segment opposite the first end of the vertical member.

6 Claims, 4 Drawing Sheets

TABLE SAW BLADE SAFETY SYSTEM

BACKGROUND

This patent application relates to table saws and more particularly table saw safety devices.

Table saws are extremely useful, but potentially dangerous tools. In this regard, it is not uncommon for such saws to be equipped with safety equipment, such as a saw blade cover, riving knife, anti-kickback pawls, etc. The saw blade cover is typically suspended over the saw blade using the riving knife, as shown in FIG. 1. For certain cuts, however, the riving knife and/or the cover may get in the way, such as when using a table saw sled, forcing the user to remove the saw blade cover and thereby defeating the safety feature entirely. Accordingly, there is a need for a table saw blade safety cover system that is not so limited.

SUMMARY

A safety system for a table saw is provided that includes: a generally U-shaped structure having a horizontal bottom segment, a vertical segment extending from a first end of the horizontal bottom segment, and a horizontal top segment extending from a first end of the vertical member opposite the first end of the horizontal bottom segment; a receiver having an end configured for receiving a second end of the horizontal bottom segment opposite the first end thereof; and a saw blade cover coupled to a distal end of the horizontal to segment opposite the first end of the vertical member.

In one embodiment, the receiver is configured for being attached underneath a table saw top and wherein the generally U-shaped structure elevates the saw blade cover over the table saw top without obstructing the table saw top.

In one embodiment, at least two of: the horizontal top segment, the vertical segment, and the horizontal bottom segment are removably attached to each other.

In one embodiment, at least one of: the horizontal top segment, the vertical segment, and the horizontal bottom segment is telescopically extendible.

In one embodiment, the receiver has a tubular shape and wherein the tubular receiver accepts the horizontal bottom segment in a sliding arrangement.

In one embodiment, the receiver has openings at opposing ends each for receiving the horizontal bottom segment in a sliding arrangement.

In one embodiment, the receiver comprises a locking mechanism and wherein the receiver accepts the horizontal bottom segment in a sliding arrangement unobstructed, therewith allowing a user to adjust a distance of the vertical segment from a side of a table saw top and lock the horizontal bottom segment with respect to sliding movement.

In one embodiment, the horizontal bottom segment has a plurality of equally spaced holes and wherein the locking mechanism is configured to selectively engage one of the plurality of equally spaced holes.

In one embodiment, the horizontal top and bottom segments are essentially parallel to each other.

In one embodiment, the vertical segment is essentially perpendicular to at least one of the horizontal top and bottom segments.

In one embodiment, the horizontal top segment comprises an extension segment telescopically extendible from the horizontal top segment.

In one embodiment, the horizontal top segment comprises a locking mechanism and wherein the horizontal top segment accepts the extension segment in a sliding arrangement, therewith allowing a user to adjust a distance of the saw blade cover from the vertical segment.

In one embodiment, the receiver comprises a locking mechanism and wherein the receiver accepts the horizontal bottom segment in a sliding arrangement unobstructed, therewith allowing a user to adjust a distance of the vertical segment from a side of a table saw top and lock the horizontal bottom segment with respect to sliding movement.

In one embodiment, the horizontal bottom segment has a plurality of equally spaced holes and wherein the locking mechanism thereof is configured to selectively engage one of the plurality of equally spaced holes.

In one embodiment, the extension segment has a plurality of equally spaced holes and wherein the locking mechanism thereof is configured to selectively engage one of the plurality of equally spaced holes.

In one embodiment, the plurality of equally spaced holes in the horizontal bottom segment and in the extension segment have the same spacing.

In one embodiment, the saw blade cover is pivotally coupled to the horizontal top segment extending at a distal end opposite the first end of the vertical segment.

DETAILED DESCRIPTION

The present application provides a table saw blade safety system which overcomes some or all the drawbacks associated with those in the art. Although the safety system may be discussed herein in relation to a certain type of table saws, it is understood that the system may be applied to various types of circular table saws, such as a cabinet, contractor, and tile type table saws, etc., as well as non-circular saws, such as band saws, scroll saws, etc. Accordingly, the system is not limited for use on any one type of table saw.

Figure 1:
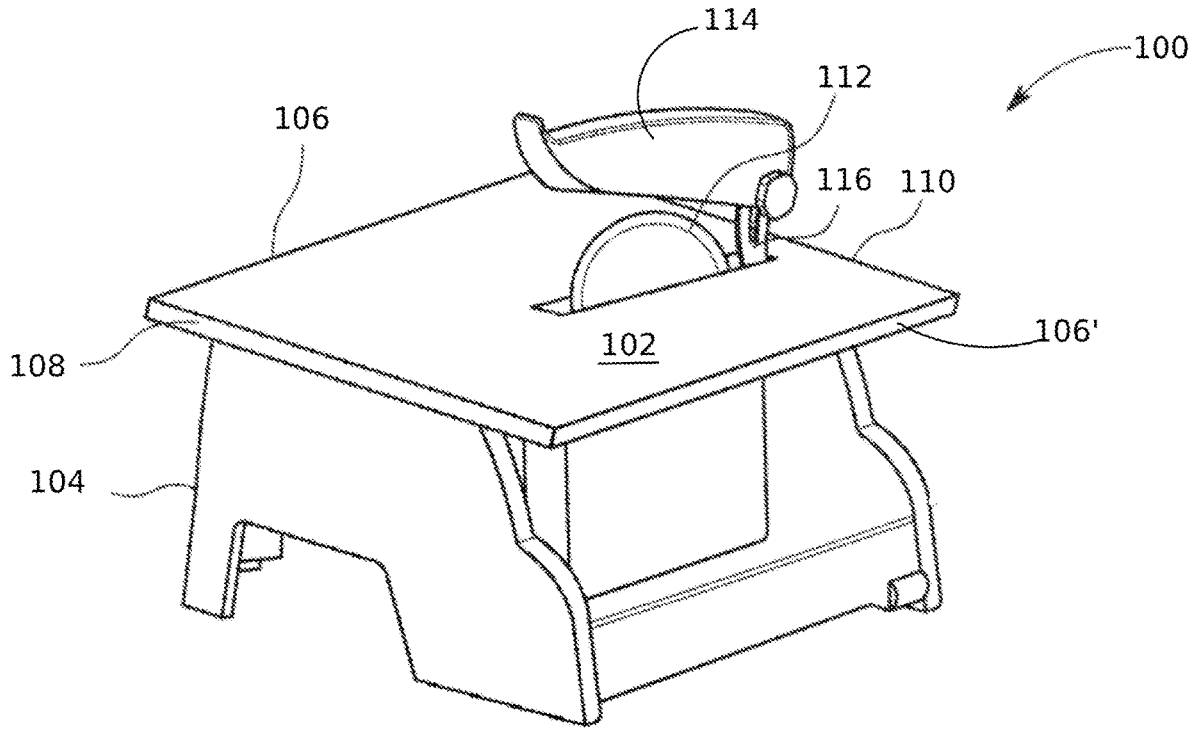
FIG. 1 is a perspective view showing a typical table saw.
Figure 2:
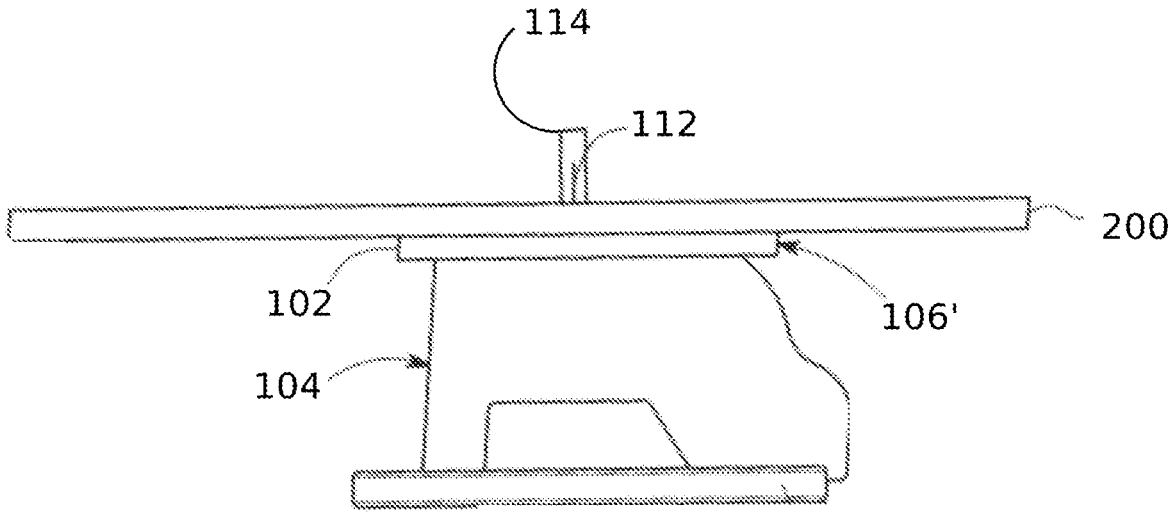
FIG. 2 is a front view showing a typical table saw in use.

Referring to FIG. 1, a table saw 100 generally includes a tabletop 102 and a base 104 to which the tabletop 102 is affixed and supported thereby. The tabletop 102 has a left side 106 and a ride side 106' (opposite the left side 106). The left and right sides 106, 106' may be parallel to each other. The tabletop 102 further includes a front 108 and back 100 (opposite the front 108). The front and back 108, 110 may be parallel to each other and may be perpendicular to the sides 106, 106'. The tabletop 102 preferably includes therein a slot through which the saw blade 112 protrudes, such as the circular saw blade shown. The saw blade 112 is preferably retractable relative to the top 102. Material 200 that is being cut is placed on the top 102 and while the saw blade 112 is rotating, the user pushes the material 200 through the blade 112, as shown in FIG. 2. Crosscuts may be achieved using a sled (not shown) that maintains the material 200 at the desired orientation relative to the plane of the blade, for example, at right angles, 45 degrees, etc.

The table saw 100 may include a safety system, such as a saw blade cover 114. The cover 114 is typically attached to the top 102 with a riving knife 116. The cover 114 and/or the riving knife 116 may interfere, for example, when the user opts to use the saw 100 with the crosscut sled.

Figure 3:
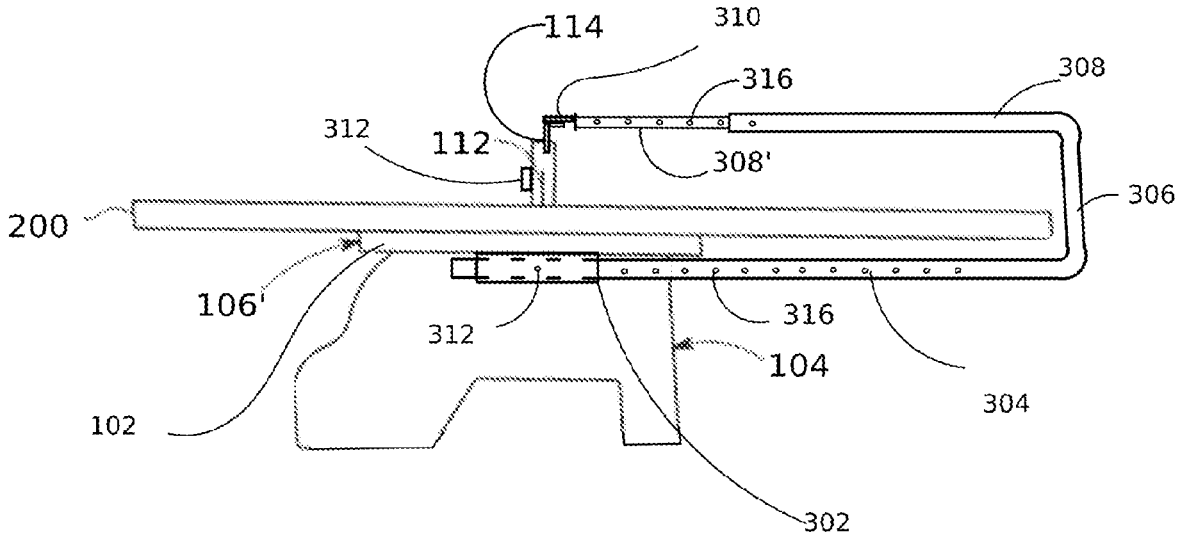
FIG. 3 is a rear view showing a table saw blade safety system according to at least one embodiment of the systems disclosed herein functionally coupled to a table saw.

Referring to FIG. 3, a safety system for a table saw 100 is provided that elevates the saw blade cover 114 over the top 102 without the need for a riving knife 116 or similar structure that extends upward and/or outward from the plane of the top 102. Preferably, the system provides a suspended cover 114 such that the entire planar surface or at least the area near and/or around the saw blade of the top 102 remains unobstructed by the safety system. In one embodiment, the system includes a generally U-shaped structure, as shown. This structure is preferably formed by tubing bent to provide the desired shape. The interior space within this U-shape accommodates or otherwise provides clearance for the material being cut 200, as shown. In this regard, the U-shaped structure may include a horizontal bottom segment 304, followed by a bend that leads to a vertical segment 304, which may be followed by another bend that leads to a horizontal top segment 308. The system may be configured for use in various size table saws and for various size materials. Accordingly, the dimensions of these segments may vary according to need. For example, the bottom segment may have a length of between about 18 inches to about 48 inches. The height of the vertical element 306 may be between about 6 inches and about 18 inches. The tubing may have an inside dimension/diameter ranging from ¾" to 4". Moreover, the segments may be telescopic and/or extendible to accommodate these different dimensions.

The U-shaped structure is preferably coupled to the bottom of the tabletop 102 (opposite the top surface of the tabletop 102), as shown, to limit any interference with the material 200. This may be accomplished in a variety of ways. In one embodiment, a tubular receiver 312 is provided that attaches, e.g., with screws or the like, to the tabletop 102. The tubular receiver 302 accepts, in a sliding arrangement, the bottom segment 304. The tubular receiver 302 may be open at both ends for the bottom segment 304 to be inserted from either end and slide therein unobstructed, and therewith allowing users to adjust the distance of the vertical segment 306 from the sides 106, 106' of the tabletop 102. The receiver 302 may have a locking mechanism 312, which may be a threaded bolt that when screwed into the receiver 322 locks the bottom segment 304 with respect to sliding movement. The bottom segment 304 and/or the receiver 302 may have circular cross sections to allow the bottom segment 304 to rotate within the receiver 302, thereby providing height adjustability with respect to the top segment 308 relative to the tabletop 102. The locking mechanism 312 preferably also locks the bottom segment 304 with respect to rotational movement relative to the receiver 302. In one embodiment, the bottom segment 304 includes a plurality of equally spaced holes 316 for positive engagement with the locking mechanism 312.

The bottom segment 304 may be a straight pipe that is placed to be essentially parallel, that is, within reasonable manufacturing tolerances, relative to the planer tabletop 102. The segments 304, 306, 308 may be constructed of a continuous pipe or separate interlocking pipes that are assembled for use. The orientation of the pipes may vary, but in a preferred embodiment, the vertical segment 306 is essentially perpendicular to the bottom segment 304, and the top segment 308 is essentially perpendicular to the vertical segment 306. As discussed, the segments may be telescopic and/or extendible to adjust the vertical and/or horizontal dimensions thereof.

In one embodiment, the top segment 308 is telescopically extendible. For example, the top segment 308 may have an extension 308' that extends outward from the open end of the top segment 308 so as to increase the total length of the top segment 308 up to the cover 114. Preferably, the extension 308 includes therein a locking mechanism that locks the extension 308' relative to the top segment 308 laterally and/or rotationally. The locking system may include a plurality of holes 316 in the extension 308' and/or the top segment 308 (not shown), preferably spaced equally the same as the holes in the bottom segment 304, so that extension of the bottom segment 304 and the extension 308' a certain number of spaces results in an equal total extension of the bottom segment 304 and the top segment 308.

Figure 4:
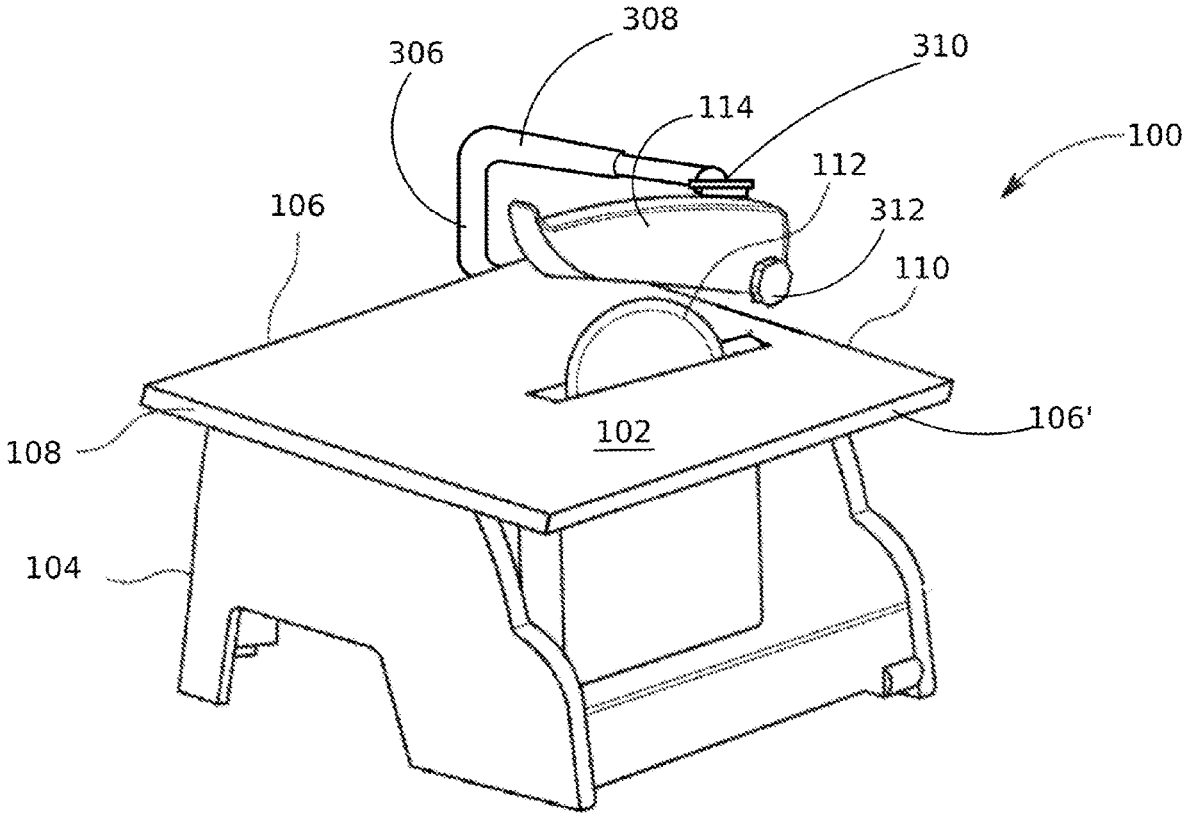
FIG. 4 is a perspective view showing a table saw blade safety system according to at least one embodiment of the systems disclosed herein functionally coupled to a table saw.

The safety system includes a cover 114 that is preferably pivotally attached to the distal end of the top segment 308 and/or extension 308'. This may be achieved in a variety of ways. In one embodiment, a structure 310 having an essentially vertical planer plate is attached to the distal end of the extension 308' and the cover 114 is configured to pivot or rotate in the plane of the planer structure 310. A locking mechanism 312, such as a screw threaded through the cover 114 and that selectively contacts and/or engages the planar structure 310 to fix the orientation of the cover 114 relative to the structure 310, as shown in FIGS. 3-4.

Beneficially, the design of the safety system allows the system to be removed from the tabletop, for example, for storage. The tubular elements further allow the system to be used as a conduit for liquid, for example, for a tile saw. Similarly, the tubing may provide a conduit for dust control. Other benefits are apparent to one skilled in the art.

While the foregoing has been described in some detail for purposes of clarity and understanding, it will be appreciated by one skilled in the art, from a reading of the disclosure, that various changes in form and detail can be made without departing from the true scope of the invention.

The invention claimed is:

1. A safety system comprising:

a table saw, the table saw comparing a table saw top having a top surface and a lower surface opposite the top surface;

a structure having a horizontal bottom segment, a vertical segment connected to the horizontal bottom segment and extending from a first end of the horizontal bottom segment, and an extendible horizontal top segment connected to the vertical segment and extending from a first end of the vertical segment opposite the first end of the horizontal bottom segment, wherein the extendible horizontal top segment comprises an extension segment slidingly extendible outward from the horizontal top segment to adjustably increase a length of the horizontal top section and a first locking mechanism, the extension segment having a plurality of horizontal holes therein spaced a first distance apart, the first locking mechanism configured to selectively engage the plurality of horizontally spaced holes of the extension member and wherein the table saw top is disposed between the horizontal top segment and the horizontal bottom segment;

a receiver attached directly to the lower surface of the table saw top, the receiver having a tubular structure with openings at opposing ends for receiving in a sliding arrangement a second end of the horizontal bottom segment opposite the first end thereof, the horizontal bottom segment slidingly extendible outward from the tubular receiver for adjusting a horizontal distance between a side of the table saw top and the vertical segment, wherein the receiver comprises a second locking mechanism, the horizontal bottom segment having a plurality of horizontal holes therein spaced a second distance apart, the second locking mechanism configured to selectively engage the plurality of horizontal holes, and wherein the first distance of the plurality of holes of the extension segment is equal to the second distance of the plurality of holes of the horizontal bottom segment and wherein the tubular structure of the receiver is parallel to the extendible horizontal top segment; and a saw blade cover coupled to a distal end of the horizontal top segment, the distal end opposite the first end of the vertical segment.

2. The safety system of claim 1, wherein structure elevates the saw blade cover over the table saw top without obstructing the table saw top.

3. The safety system of claim 1, wherein is telescopically extendible.

4. The safety system of claim 1, wherein the horizontal top and bottom segments are parallel to each other.

5. The safety system of claim 1, wherein the vertical segment is essentially perpendicular to at least one of the horizontal top and bottom segments.

6. The safety system of claim 1, wherein the saw blade cover is pivotally coupled to the horizontal top segment extending at a distal end opposite the first end of the vertical segment.

* * * * *